United States Patent [19]

Schmid et al.

[11] Patent Number: 4,669,355

[45] Date of Patent: Jun. 2, 1987

[54] DISC-TYPE AMMUNITION CHANNEL FOR FEEDING AMMUNITION FROM A STATIONARY CHANNEL TO A FIRING WEAPON

[75] Inventors: Samuel Schmid, Dietlikon; Herbert Riedlinger, Zurich, both of Switzerland

[73] Assignee: Oerlkon-Bührle AG Werkzeugmaschinenfabrik, Zürich, Switzerland

[21] Appl. No.: 686,473

[22] Filed: Dec. 26, 1984

[30] Foreign Application Priority Data

Jan. 11, 1984 [CH] Switzerland ..... 123/84

[51] Int. Cl.[4] ..... F41D 10/02; F41D 10/40

[52] U.S. Cl. ..... 89/33.1; 193/25 AC

[58] Field of Search ..... 89/33.1, 33.01, 33.14, 89/33.16, 33.17, 33.02; 193/25 AC, 25 C

[56] References Cited

U.S. PATENT DOCUMENTS

| | | | |
|---|---|---|---|
| 2,310,884 | 2/1943 | Trevaskis | 89/33.01 |
| 2,936,677 | 5/1960 | Vickers | 89/33.16 |
| 3,021,761 | 2/1962 | Tillander | 89/33.01 |
| 4,416,184 | 11/1983 | Jenny | 193/25 AC |
| 4,474,102 | 10/1984 | Tassie | 89/33.17 |

FOREIGN PATENT DOCUMENTS

| | | | |
|---|---|---|---|
| 0041280 | 12/1981 | European Pat. Off. | 193/25 AC |
| 0072668 | 2/1983 | European Pat. Off. | 89/33.17 |
| 1112925 | 4/1958 | Fed. Rep. of Germany | 89/33.16 |
| 2948685 | 6/1981 | Fed. Rep. of Germany | 89/33.14 |
| 3204499 | 2/1982 | Fed. Rep. of Germany | 89/33 |
| 0583360 | 6/1946 | United Kingdom | 89/33.14 |
| 0590783 | 7/1947 | United Kingdom | 193/25 AC |

*Primary Examiner*—Charles T. Jordan
*Assistant Examiner*—Stephen M. Johnson
*Attorney, Agent, or Firm*—Werner W. Kleeman

[57] ABSTRACT

The disc-type ammunition channel contains a predetermined number of discs or lamellae arranged adjacent one another and which can be rotated in a substantially cylindrical housing. The diameter of the discs or lamellae and of the cylindrical housing is smaller than the length of the cartridges to be passed therethrough. The tip ends of the projectiles of the cartridges protrude from the discs or lamellae into a housing member which is formed by two substantially helically shaped walls and a substantially cylindrical wall. Rotation of the discs or lamellae as a function of the elevation of the firing weapon is insured by a rod which is secured at one of its ends to a stationary housing member and at the other one of its ends to an elevatable housing member by means of rubber joints. The rod extends through elongated or oblong slots provided in the discs.

6 Claims, 4 Drawing Figures

DISC-TYPE AMMUNITION CHANNEL FOR FEEDING AMMUNITION FROM A STATIONARY CHANNEL TO A FIRING WEAPON

BACKGROUND OF THE INVENTION

The present invention relates to a new and improved construction of a disc-type ammunition channel for feeding ammunition comprising cartridges or the like of a predetermined length from a stationary ammunition channel to a firing weapon which is elevatable by rotation about a predetermined elevational axis.

In its more particular aspects, the present invention relates specifically to a disc-type ammunition channel for feeding ammunition comprising ordnance, such as cartridges of a predetermined length from a stationary ammunition channel through a disc or lamellae channel or passage to a firing weapon which is elevatable by rotation about a predetermined elevational axis. This disc-type ammunition channel comprises a multiple number of discs or lamellae which are rotatable about the predetermined elevational axis and which are provided with through-pass openings for the ammunition. The rotation or rotary angle of the discs or lamellae increases in steps of equal amounts from the stationary ammunition channel to the elevatable firing weapon. A tensionally and torsionally resilient element is passed through the discs or lamellae. These discs or lamellae are guided at the inner wall of a substantially cylindrical housing or member.

In an ammunition feeding apparatus for a rapid-fire weapon as known, for example, from German Patent Publication No. 3,204,499, the discs or lamellae are guided at the inner wall of the cylindrical housing at three points. These discs or lamellae are furthermore interconnected by a transmission having a transmission ratio which decreases from one disc to the other. The discs or lamellae are additionally connected to each other, to the weapon and to the channel by means of elastic connecting members.

The most various constructions of such ammunition feeding apparatus are known and reference is made in this respect to, for example, European Patent Publication No. 0,041,280, corresponding to U.S. Pat. No. 4,416,184, as well as British Patent Nos. 583,410 and 590,783. All of these ammunition feeding apparatus have the disadvantage of requiring a relatively large amount of space and possess large size and great weight.

SUMMARY OF THE INVENTION

Therefore, with the foregoing in mind, it is a primary object of the present invention to provide a new and improved construction of a disc-type ammunition channel for feeding ammunition, such as cartridges of a predetermined length from a stationary ammunition channel to a firing weapon which is elevatable by rotation about a predetermined elevational axis, and which disc-type ammunition channel is constructed to be as light and as compact as possible and occupies very little space.

Another and more specific object of the present invention is directed to the provision of a new and improved construction of a disc-type ammunition channel for feeding ammunition of a predetermined length from a stationary ammunition channel to a firing weapon which is elevatable about a predetermined elevational axis, and which disc-type ammunition channel possesses a gas-tight housing, so that no combat gases or waste gases may enter the housing in the event that, for example, the firing weapon is mounted externally of an armored turret and the ammunition is located within the armored turret.

Now in order to implement these and still further objects of the invention, which will become more readily apparent as the description proceeds, the disc-type ammunition channel of the present development is manifested by the features that, the diameter of the substantially cylindrical housing and of the discs or lamellae is smaller than the length of the ammunition to be passed there-through, and the substantially cylindrical member of the housing has an opening from which the tip ends of the ammunition protrude.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
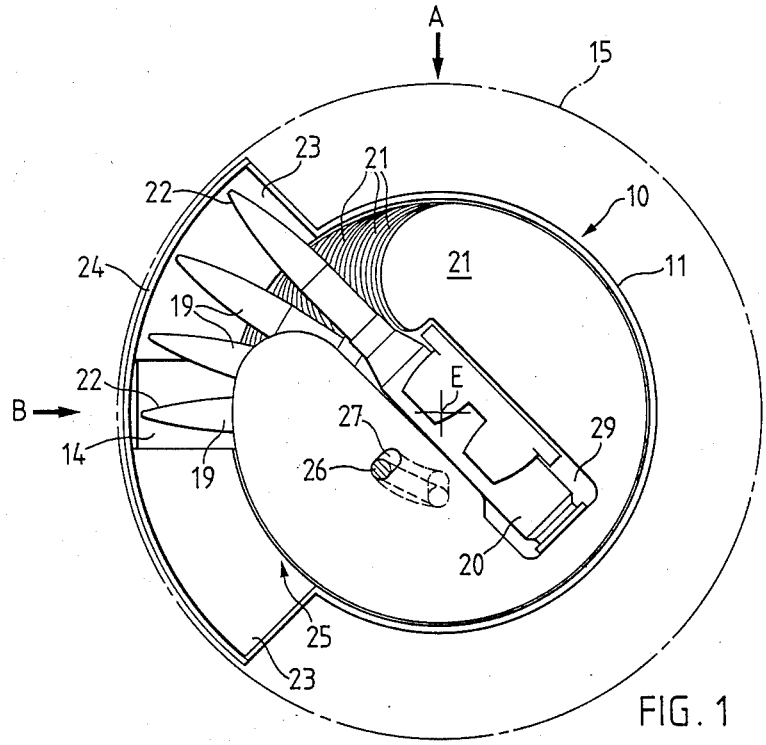
FIG. 1 is a view of the disc-type ammunition channel according to the invention as seen in the direction of the predetermined elevational axis of the firing weapon.

Describing now the drawings, it is to be understood that only enough of the construction of the disc-type ammunition channel or flexible ammunition chute has been shown as needed for those skilled in the art to readily understand the underlying principles and concepts of this invention, while simplifying the showing of the drawings. Turning attention now specifically to FIGS. 3 and 4, there has been illustrated an exemplary embodiment of the disc-type ammunition channel or flexible ammunition chute for enabling the feeding of ammunition from a stationary ammunition container or magazine (not shown) via a stationary or first ammunition feeding channel 13 to a suitable firing weapon (not shown) which is elevatable by rotation about a predetermined elevational axis E in conventional manner. The ammunition feed is effected through an elevatable or second ammunition feeding channel 16, which is elevatable conjointly with the automatic firing weapon, in any desired position of such firing weapon.

The disc-type ammunition channel comprises a stationary housing 10 into which the stationary ammunition feeding channel 13 opens and from which the ammunition enters the elevatable ammunition feeding channel 16.

This housing 10 possesses a substantially cylindrical housing member 11. According to FIG. 3, a stationary housing member or disc-shaped wall 12 is secured to one end of the substantially cylindrical housing member 11. At its other end, the substantially cylindrical housing member 11 is closed by a rotary housing member or second disc-shaped wall 15 which gas-tightly bears upon the substantially cylindrical housing member 11 and which is rotatable conjointly with the firing weapon about the predetermined elevational axis E as indicated by the bi-directional arrow in FIG. 4. Rectangular apertures or openings 14 and 17 are respectively cutout from the stationary housing member or disc-shaped wall 12 as well as from the oppositely situated rotary housing member or disc-shaped wall 15. The ammunition enters the housing 10 from the stationary ammunition feeding channel 13 through the first aperture 14 and enters the elevatable or rotary ammunition feeding channel 16 from the housing 10 through the second aperture 17. Preferably, the two ammunition feeding channels 13 and 16 are secured, for example, by welding or in any other appropriate manner to the stationary housing member or disc-shaped wall 12 and to the rotary housing member or disc-shaped wall 15, respectively.

A predetermined number of discs or lamellae 21 are provided within the housing 10 of the disc-type ammunition channel. All these discs or lamellae 21 have essentially the same structure and each of these discs or lamellae 21 comprises an approximately retangular cutout or through-pass opening 29 in which the belted ammunition is guided. The diameter of these discs or lamellae 21 is smaller than the predetermined length of the ammunition or cartridges 18 to 20, see FIG. 2, and thus the tip end 22 of the projectiles of the ammunition or cartridges protrudes outwardly from the discs or lamellae 21. The discs or lamellae 21 are rotatably mounted in the substantially cylindrical housing member 11.

Figure 4:
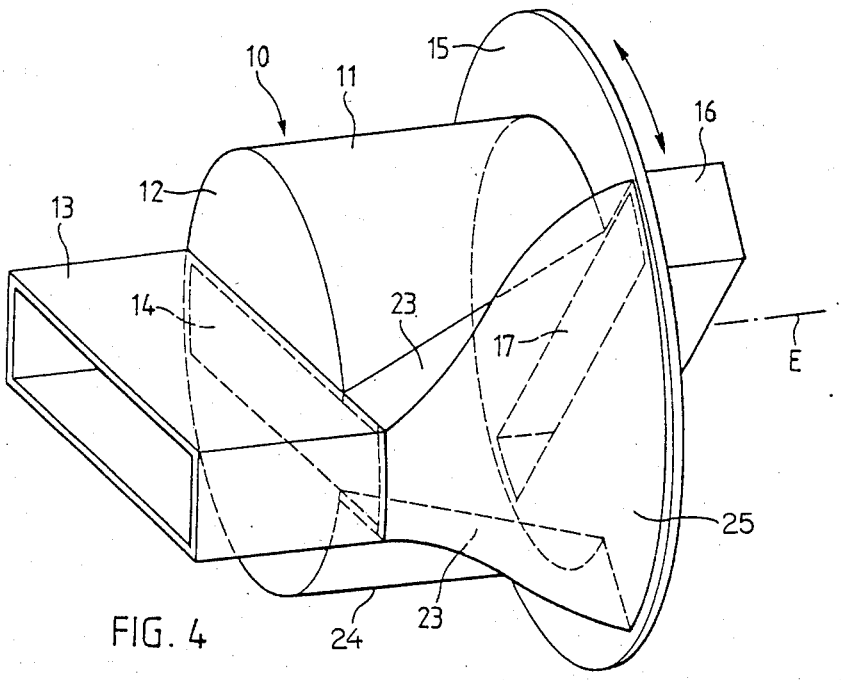
FIG. 4 is a perspective illustration of the disc or lamella channel of the disc-type ammunition channel shown in FIG. 1.

According to FIG. 4, the substantially cylindrical housing member 11 defines an opening 25 which widens from the stationary housing member or wall 12 towards the oppositely situated rotary housing member or wall 15 in a substantially funnel-shaped manner. This opening 25 is bounded or enclosed by two walls 23 twisted in a substantially helical shape and by a substantially cylindrical wall 24.

As shown in FIG. 1, the tip ends 22 of the projectiles of the ammunition or cartridges 18 to 20, protrude through this opening 25 of the substantially cylindrical housing member 11 into the space which is bounded by the substantially helical walls 23 and the substantially cylindrical wall 24.

Figure 2:
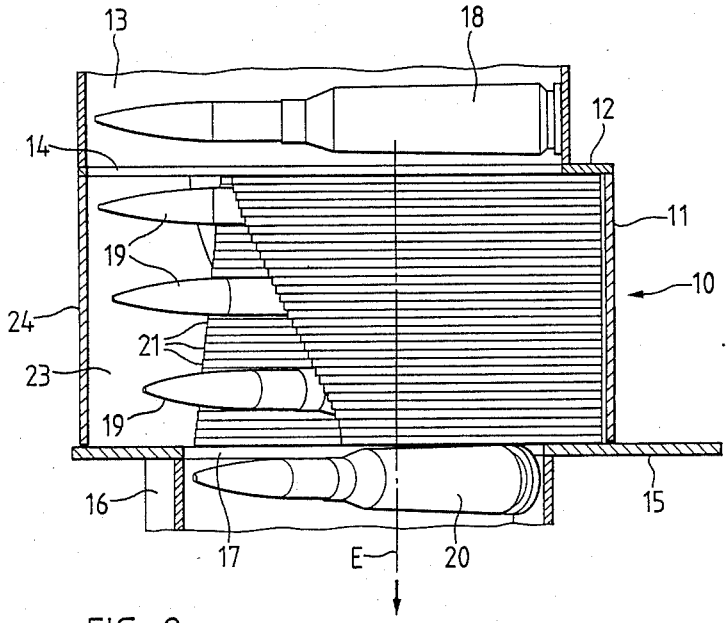
FIG. 2 is a partial sectional view looking in the direction of the arrow A in FIG. 1.

As shown in FIG. 2, one piece of ammunition or cartridge 18 is still present in the stationary ammunition feeding channel 13, three pieces of ammunition or cartridges 19 are present in the housing 10 and a further piece of ammunition or cartridge 20 has already reached the elevatable or movable ammunition feeding channel 16.

In order to form a substantially helical-shaped channel for the pieces of ammunition or cartridges 19 by means of the predetermined number of discs or lamellae 21, each one of these discs 21 must be rotated by a somewhat greater angle relative to its adjacent disc or lamellae 21 during elevation of the firing weapon. Actually, the individual discs or lamellae 21 of the predetermined number of discs or lamellae 21 are progressively rotatable in steps of approximately equal angles in the direction from the stationary ammunition feeding channel 13 to the elevatable ammunition feeding channel 16 or to the firing weapon.

Figure 3:
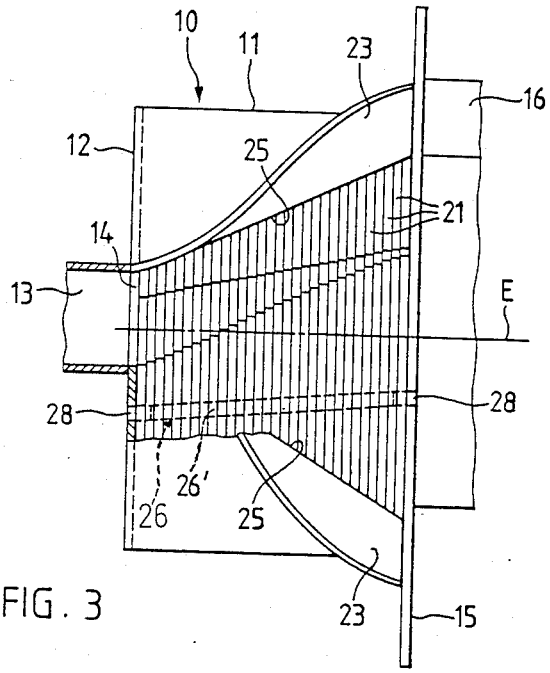
FIG. 3 is a partial sectional view looking in the direction of the arrow B in FIG. 1.

For the purpose of such rotation of the multiple number of discs or lamellae 21, a tensionally and torsionally resilient element 26 is provided and contains a rod 26' which is linked with one of its ends to the stationary housing member or disc-shaped wall 12 and with the other one of its ends to the rotary housing member or disc-shaped wall 15 as will be evident from FIG. 3. The rod 26' extends through radially directed oblong slots or holes 27 in the discs or lamellae 21. Since the amount of rotation or pivoting of the discs or lamellae 21 is small, it will be sufficient to use rubber joints or hinges 28, which are also designated as rubber cushions, in order to obtain the articulated mounting of the rod 26'.

The illustrated exemplary embodiment of the disc-type ammunition channel enables an elevation operation by about 90°. In accordance with FIG. 1, the piece of ammunition or cartridge 18 which is shown in its starting position, can be rotated from such starting position either clockwise by about 45° or counterclockwise also by about 45°. In the case that an elevation of the firing weapon is desired from the horizontal position by 90° to the zenith, the piece of ammunition or cartridge 18 is already inclined by about 45° relative to the horizontal in its starting position. However, in the case that a lowering or depression of the firing weapon is desired, the piece of ammunition or cartridge 18, in its starting position, would be inclined at a somewhat smaller angle relative to the horizontal.

While there are shown and described present preferred embodiments of the invention, it is to be distinctly understood that the invention is not limited thereto, but may be otherwise variously embodied and practiced within the scope of the following claims. Accordingly,

What we claim is:

1. A disc-type ammunition channel for feeding ammunition comprising cartridges of a predetermined length from a stationary ammunition channel to a firing weapon which is at least elevatable by rotation about a predetermined elevational axis, comprising:

a housing containing a substantially cylindrical housing member;

said substantially cylindrical housing member defining a predetermined diameter and an inner wall;

a predetermined number of discs having a predetermined diameter and arranged within said substantially cylindrical housing member;

each one of said predetermined number of discs being provided with a through-pass opening for said cartridges and being rotatable about said predetermined elevational axis;

said predetermined number of discs being progressively rotatable in steps of approximately equal angles from said stationary ammunition feeding channel to said elevatable firing weapon;

a tensionally and torsionally resilient element guided through said predetermined number of discs;

said predetermined number of discs being guided at said inner wall of said substantially cylindrical housing member;

said predetermined diameter of said substantially cylindrical housing member and said predetermined diameter of each one of said predetermined number of discs being smaller than said predetermined length of the cartridges to be passed through said through-pass openings of said discs;

each one of said cartridges defining a tip end;

said substantially cylindrical housing member comprising an opening; and said tip ends of said cartridges fed through said disc-type ammunition channel, protruding from said opening of said substantially cylindrical housing member and from said through-pass openings provided in said predetermined number of discs.

2. The apparatus as defined in claim 1, wherein:

said opening in said substantially cylindrical housing member widens in a substantially helical manner in the direction towards said firing weapon and to an extent as required by the elevation of said firing weapon; and said opening being bounded by substantially helically extending walls and by a substantially cylindrical wall.

3. The apparatus as defined in claim 1, wherein:

said housing further contains a stationary housing member and a rotary housing member rotatable relative to said stationary housing member and about said elevation axis;

said tensionally and torsionally resilient element being linked with one end to said stationary housing member and with its other end to said rotary housing member; and said tensionally and torsionally resilient element comprising rubber joints at said one end and at said other end thereof and a rod interconnecting said rubber joints.

4. The apparatus as defined in claim 1, wherein:

each of said discs having a center located essentially at the location of said predetermined elevational axis.

5. The apparatus as defined in claim 4, wherein:

each of said discs defines a substantially round disc.

6. The apparatus as defined in claim 5, wherein each of the cartridges has a mass center and wherein:

the center of each of said discs being located at said predetermined elevational axis and essentially coinciding with the mass center of the cartridges.

* * * * *

UNITED STATES PATENT AND TRADEMARK OFFICE

CERTIFICATE OF CORRECTION

PATENT NO. : 4,669,355

DATED : June 2, 1987

INVENTOR(S) : SAMUEL SCHMID et al

It is certified that error appears in the above-identified patent and that said Letters Patent is hereby corrected as shown below:

Title Page, Column 1, line 10, please delete "Oerlkon-Bührle" and insert --Oerlikon-Bührle--

Column 2, line 12, after "passed" please delete "there-through" and insert --therethrough--

Signed and Sealed this

Fifth Day of January, 1988

*Attest:*

*Attesting Officer*

DONALD J. QUIGG

*Commissioner of Patents and Trademarks*